US005839869A

United States Patent [19]

Moran et al.

[11] Patent Number: 5,839,869

[45] Date of Patent: Nov. 24, 1998

[54] SEAMING APPARATUS

[75] Inventors: Peter Leslie Moran, Fairford; Robin Fergusson; David Livingstone, both of Royston; Paul Simms, Silsen; Nicholas Charles Martinek, Huddersfield, all of United Kingdom

[73] Assignee: CarnaudMetalbox plc, United Kingdom

[21] Appl. No.: 552,360

[22] Filed: Nov. 2, 1995

[30] Foreign Application Priority Data

Nov. 3, 1994 [GB] United Kingdom ..... 9422228

[51] Int. Cl.[6] ..... B21D 51/32

[52] U.S. Cl. ..... 413/31; 413/6; 413/27

[58] Field of Search ..... 413/5–7, 31, 35–37, 413/41, 26, 27; 53/340, 366, 486, 488; 74/384, 390, 397–399

[56] References Cited

U.S. PATENT DOCUMENTS

| | | | |
|---|---|---|---|
| 1,349,837 | 8/1920 | Johnson | 413/31 |
| 1,699,069 | 1/1929 | Huntar | 413/37 |
| 2,166,923 | 7/1939 | Woodcock | 74/397 |
| 2,216,082 | 9/1940 | Kronquest et al. | 413/31 |
| 2,522,301 | 9/1950 | Rooney | 413/31 |
| 2,527,885 | 10/1950 | Krueger | 413/31 |
| 2,975,740 | 3/1961 | Smith et al. . | |
| 2,991,602 | 7/1961 | Van De Kerke et al. | 53/486 |
| 3,186,003 | 5/1965 | Gregory, Jr. et al. | 74/399 |
| 4,004,478 | 1/1977 | Morgan | 74/397 |
| 4,022,141 | 5/1977 | Bartenstein | 413/40 |
| 4,762,579 | 8/1988 | Shimizu et al. | 413/12 |
| 4,808,053 | 2/1989 | Nagai et al. | 413/30 |
| 4,942,777 | 7/1990 | Fife | 74/397 |
| 5,014,491 | 5/1991 | Tsukada et al. | 53/366 |
| 5,078,564 | 1/1992 | Zago | 413/30 |
| 5,325,696 | 7/1994 | Jentzsch et al. | 72/117 |

*Primary Examiner*—Michael J. Carone
*Assistant Examiner*—Darren Ark
*Attorney, Agent, or Firm*—Diller, Ramik & Wight, PC

[57] ABSTRACT

Apparatus for seaming an end E to an open end of a container body B in at least first and second seaming operations comprises a lifter pad to support the container body, a seaming chuck to support the end in place on the container body, and an annular seaming tool having at least first and second annular seaming profiles on its inner surface which surrounds the end. The apparatus includes drive means for providing relative rolling movement between the seaming tool and the end in which the drive means drives the annular seaming tool to gyrate around the can end. Means are also provided for causing relative movement between the end and the annular seaming tool, from a first relative position in which the first seaming profile can contact the end E to perform the first seaming operation, to at least a second relative position in which the second seaming profile can contact the end E to perform the second seaming operation.

17 Claims, 10 Drawing Sheets

SEAMING APPARATUS

FIELD OF THE INVENTION

The invention relates to apparatus for seaming an end onto an open end of a container body and in particular to apparatus for seaming a can end onto the open end of a can body. Both can end and can body will normally be made of metal although they may be made of plastic or composite materials.

DESCRIPTION OF THE RELATED ART

Typically, the seam formed by known seaming apparatus is of a type known as a double seam. During the seaming operation the seaming flange and peripheral curl of a can end are progressively folded together with a seaming flange on the open end of the can body. In conventional high speed seaming apparatus the can body is supported on a rotating lifter pad and the can end is pressed down onto the can body by a rotating seaming chuck which must be accurately aligned axially with the lifter pad.

The folding of the seam is normally carried out in two stages by two separate seaming rolls which are in turn brought into radial engagement with the peripheral portion of the can end.

In another known apparatus (described in U.S. Pat. No 4,808,053) the seam is formed by rolling the can end along an arcuate rail; the rail having a radius of curvature many times that of the can end.

Conventional apparatus is considered to have a number of disadvantages. Firstly the seaming rolls or rails engage the can end over a very short circumferential extent so the folding of the metal is fairly rapid and aggressive. This in turn limits the ability of current seamers to operate on can bodies and can ends formed from ultra thin steel or aluminium.

Further, rotation of the filled can during seaming gives rise to a high risk of spillage. Also the seaming rolls must rotate at high speed and their bearings must therefore be lubricated. It has not been possible to provide an absolutely satisfactory seal against possible leakage of lubricant which can lead to contamination of the contents of the can. In conventional high speed seamers the filled can is lifted at high speed into engagement with the seaming chuck. This induces a high axial impact load on the can body which can lead to collapse. Conventional high speed seamers cannot provide for seaming to take place in more than two stages since there is not enough room for more than two seaming rolls around the can. Nor can conventional high speed seamers seam ends to irregular non-circular cans.

Conventional seamers normally do not provide for on line monitoring of the seam nor for automatic seam setting adjustment, and mechanical adjustment of conventional seamers is needed to accommodate different material thicknesses.

Italian patent No. 770893 describes seaming apparatus in which an annular seaming tool closely surrounds the container end. The tool is apparently mounted for floating movement in a horizontal plane and is pressed into engagement with the can end by a roller acting on the radially external surface of the tool. It appears that the tool will thus be driven to orbit the can end. It is stated in the patent that neither the can end nor the seaming tool has axial rotation.

SUMMARY

In order to improve the metal working properties of the seaming process, the present invention provides apparatus in which an annular seaming tool surrounds the can end and the tool is driven to carry out a relative rolling movement. In order to improve the compactness of the apparatus, the annular seaming tool has at least two seaming profiles on its inner surface and means are provided to move the seaming tool relative to the container end to enable the seaming profiles to contact the container end sequentially to perform the first and second seaming operations.

The present invention aims to provide an improved seaming apparatus and accordingly provides apparatus for seaming an end to an open end of a container body in at least first and second seaming operations comprising:

means to support the container body;

a seaming chuck to support the end in place on the container body; and means for progressively folding peripheral portions of the container body and end together to form a seam; characterised in that the folding means is an annular seaming tool having at least first and second annular seaming profiles on its inner surface which surrounds the end and wherein the apparatus includes drive means for providing relative rolling movement between the seaming tool and the end to form the seam progressively, wherein the drive means drives the annular seaming tool to gyrate around the can end, and there is provided means for causing relative movement between the end and the annular seaming tool, from a first relative position in which the first seaming profile can contact the end to perform the first seaming operation, to at least a second relative position in which the second seaming profile can contact the end to perform the second seaming operation. The can body is not driven to rotate during seaming, and this not only reduces the risk of spillage but also does away with the need for the support pad to rotate and to be accurately aligned with the seaming chuck.

The best metal forming characteristics are provided where the inner radius of the tool is only slightly greater than the outer radius of the can end. This is limited only by the need for clearance as the can end is located within the tool. In the case of a small container such as a beverage can, the outer diameter of the can end prior to seaming is about 60 mm. The diameter of the seaming tool may need to be about 20% greater to provide the necessary clearance. In the case of larger can ends, the diameter of the tool will not need to be so much greater than that of the can end, say 5–10% in the case of a can end of 160 mm diameter. In the case of a very small can end the diameter of the tool may need to be up to 50% greater than that of the can end. Since the diameter of the seaming tool is not substantially greater than that of the can end, the rotational speed of the seaming tool as it gyrates is relatively low, even where the rotational speed of the point of contact between the tool and the can end is as high as in the case of conventional seaming rolls. The risk of the tool skidding on the can seam is thus greatly reduced.

In a preferred embodiment, the drive means comprises an inner eccentric sleeve mounted for rotation about the axis of the seaming chuck, an outer eccentric sleeve mounted for rotation about the inner eccentric sleeve, and a drive mechanism for driving the inner and outer eccentric sleeves; wherein the annular seaming tool is mounted for rotation on the outer eccentric sleeve. By virtue of this drive means, the central axis of the seaming tool can be held in line with the central axis of the chuck or made to rotate about the central axis of the chuck. When the tool axis is aligned with the chuck axis the eccentricity of the tool is nil. This is the inoperative position of the seaming tool in which the seaming profiles thereon surround and are spaced from the can end all around it. When the central axis of the seaming tool is made to rotate such that the tool orbits around the chuck about the central axis of the chuck, the seaming profiles approach the can end as the seaming tool moves around the can end but the seaming tool does not rotate about its own axis. When the eccentricity of the tool is increased to a sufficient degree, one of the seaming profiles will engage the can end and the friction between the two will then cause the tool to rotate about its own axis. The combined motion of the tool results in it gyrating around the can end rather in the manner of a hula hoop. That is to say that the inner surface of the tool is in rolling contact with the outer periphery of the can end. This is the operative position.

The drive means of the preferred embodiment allows for extremely fine control of the eccentricity of the motion of the seaming tool between the inoperative position where its eccentricity is nil and it surrounds the periphery of the can end and is spaced therefrom, to the operative position in which its eccentricity is relatively large so that it engages the can end and gyrates around it.

In the preferred embodiment, two seaming profiles are provided one above the other on the seaming tool. If required, three or more seaming profiles can be provided.

BRIEF DESCRIPTION OF THE DRAWINGS

Embodiments of the invention are described below with reference to the accompanying drawings in which.

DESCRIPTION OF THE PREFERRED EMBODIMENTS

Figure 1:
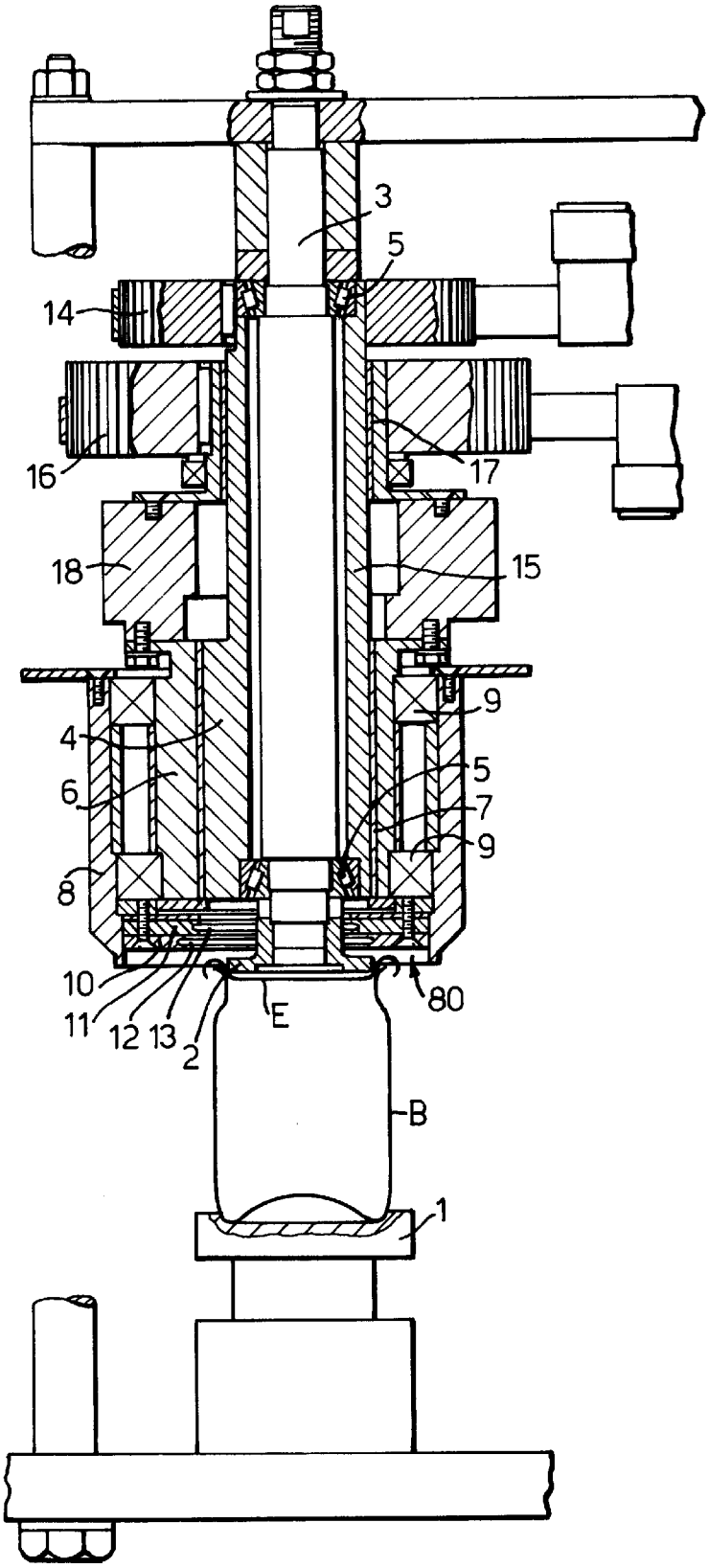
FIG. 1 shows a vertical cross section through apparatus in accordance with the invention.

Referring to FIG. 1, apparatus for seaming a can end E onto the open end of a can body B is shown. Both the can end and the can body are conventional. The can end comprises a central panel, a chuck wall surrounding the central panel, a seaming panel surrounding the chuck wall and a peripheral curl. The can body has a flared flange at its open end. Before seaming the can end is supported on the can body with the flange of the can body engaging the underside of the seaming panel of the can end. The apparatus comprises a support pad 1 for the can body and a seaming chuck 2 mounted on the lower end of a non-rotating shaft 3. An inner eccentric sleeve 4 is mounted by means of bearings 5 to rotate about the axis of the seaming chuck 2 and its shaft 3. An outer eccentric sleeve 6 is mounted by means of a bearing 7 on the outside of the inner sleeve 4 for rotation thereabout. An annular seaming tool holder 8 is mounted on the outside of the sleeve 6 for rotation thereon by means of bearings 9. The lower part of tool holder 8 holds an annular seaming tool 80 in the form of two replaceable seaming rings 10, 11 which have annular seaming profiles 12, 13 on their inner surfaces. The seaming tool 80 and the tool holder 8 may be made in one piece or as two separate components. The tool 80 may be fixedly mounted on the tool holder or may be mounted thereon for free rotation. A drive gear or wheel 14 is mounted on a cylindrical extension 15 of the inner sleeve 4 so that rotary drive can be imparted to the sleeve 4. A further drive gear or wheel 16 is mounted for rotation about the cylindrical extension 15 by means of a bearing 17 and is coupled through a coupling 18 to the outer eccentric sleeve 6. Coupling 18 is an eccentric coupling (such as a Schmidt coupling) which allows rotary drive to be transmitted to the outer sleeve 6 which rotates about the inner eccentric sleeve 4.

FIGS. 2–6 are simplified diagrammatic views of apparatus similar to that of FIG. 1 which help show how the apparatus operates. Parts in FIGS. 2–6 corresponding to parts of the apparatus of FIG. 1 have been given the same reference numerals.

Figure 3:
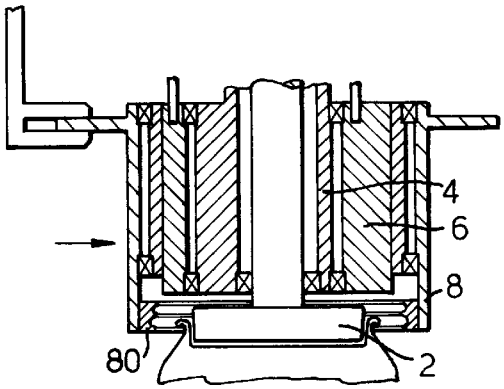
Figure 4:
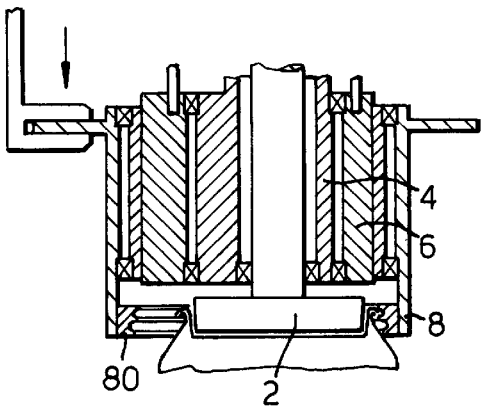
Figure 5:
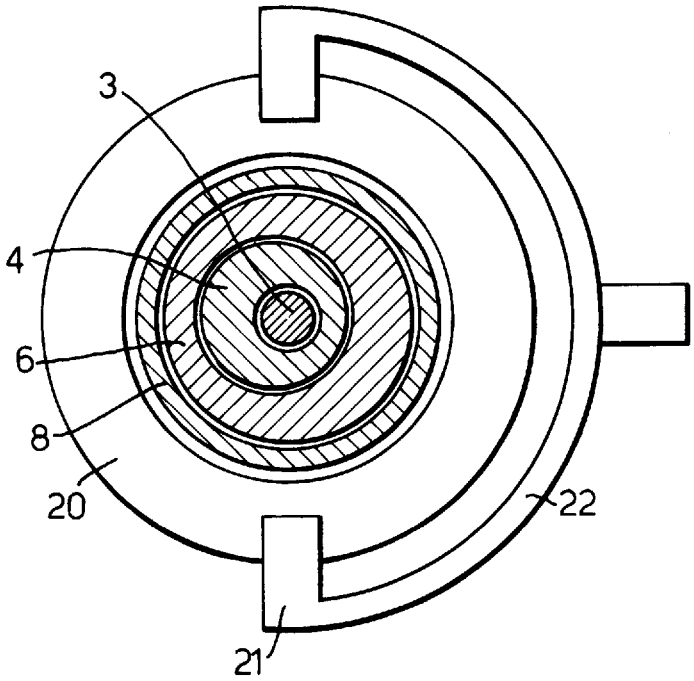
FIGS. 5 and 6 are diagrammatic horizontal sectional views of the apparatus shown in FIGS. 3 and 4.

In the position of the inner and outer sleeves 4, 6 as shown in FIGS. 3 and 5, their eccentricities are oppositely opposed and have the effect of cancelling out one another. If the sleeves are rotated at the same speed (and in the same sense) in this position the outer surface of the outer sleeve 6 will rotate about the central axis of the apparatus, that is the axis of the seaming chuck shaft 3. This is the position described below as the position in which the phase angle between the inner and outer sleeves is zero. In this position the seaming tool is mounted coaxially with the shaft 3 of the seaming chuck and its eccentricity or degree of gyration is nil. If the inner and outer sleeves are relatively rotated such that the phase angle between them is no longer zero, the outer surface of the outer sleeve 6 will rotate eccentrically about the central axis of the apparatus when the sleeves 4 and 6 are rotated together at the same speed. This eccentric motion will of course be transmitted to the annular seaming tool holder which is mounted for rotation on the outer sleeve 6 and thus to the seaming tool 80.

Figure 2:
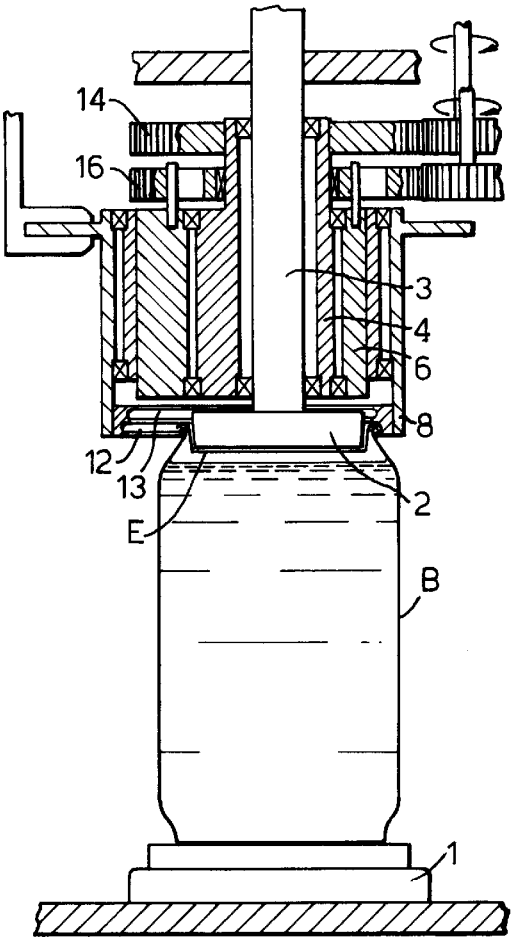
FIGS. 2, 3 and 4 are diagrammatic partial sections through apparatus similar to that of FIG. 1.
Figure 6:
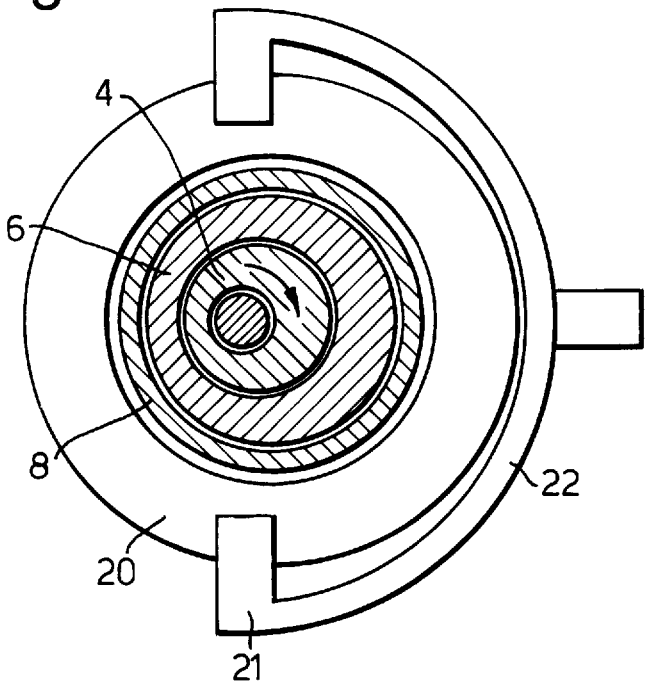

Such an eccentric position, where the phase angle between the sleeves 4,6 is 180° is shown in FIGS. 1, 2 and 6. This is the position of maximum eccentricity of the seaming tool 80.

A brief explanation of the operation of the apparatus will now be given. A can body fitted loosely with a can end is supported on the support pad and the seaming chuck 2 is located in engagement with the chuck wall of the can end E. The support pad 1 and chuck 2 exert an axial compressive force on the can body. In one embodiment, the support pad lifts the can body and can end into engagement with the seaming chuck in known manner but in the preferred embodiment the seaming chuck can move vertically into and out of the operative position. In either case, the seaming tool holder 8 along with the tool 80 can be moved axially of the chuck 2 so as to selectively align profile 12 or profile 13 with the chuck and thus with the can end periphery. Initially, the inner and outer sleeves are rotated at the zero phase angle so the seaming profiles 12, 13 are coaxial with the can end and lower profile 12 is aligned with the seaming flange of the can end. This is the position shown in FIGS. 3 and 5. When the phase angle between the sleeves is made positive, however, the axis of the seaming tool itself rotates about a circle centred on the central axis of the apparatus, and as the phase angle is increased, the radius of that circle is increased. At a certain point, profile 12 engages the outer periphery of the can end. Since the seaming tool is free to rotate it will be driven in rotation by this engagement and will gyrate about the seaming chuck and the can end. This is the position shown in FIGS. 1 and 2. As the phase angle is further increased the seaming tool will progressively fold the outer periphery of the can end inwardly. When the can end has been folded inwardly to the full extent required, the phase angle is returned to zero such that the seaming tool returns to its initial position coaxial with the seaming chuck. The seaming tool holder is then lowered to align the upper profile 13 with the seaming panel of the can end (FIG. 4) and the previous procedure is repeated to complete the seaming process. In the example shown in FIGS. 2–6, a flange 20 on the seaming tool holder 8 is engaged by bifurcated limbs 21 of a yoke 22. The limbs impart a very slight resistance to rotation of the tool holder 8 such that it does not pick up the high speed rotation of the sleeves 4,6 but is nevertheless free to roll around the can end periphery. The yoke 22 operates to raise and lower the tool holder 8 to selectively align the upper and lower profiles 12,13 with the seaming flange of the can end.

Figure 7:
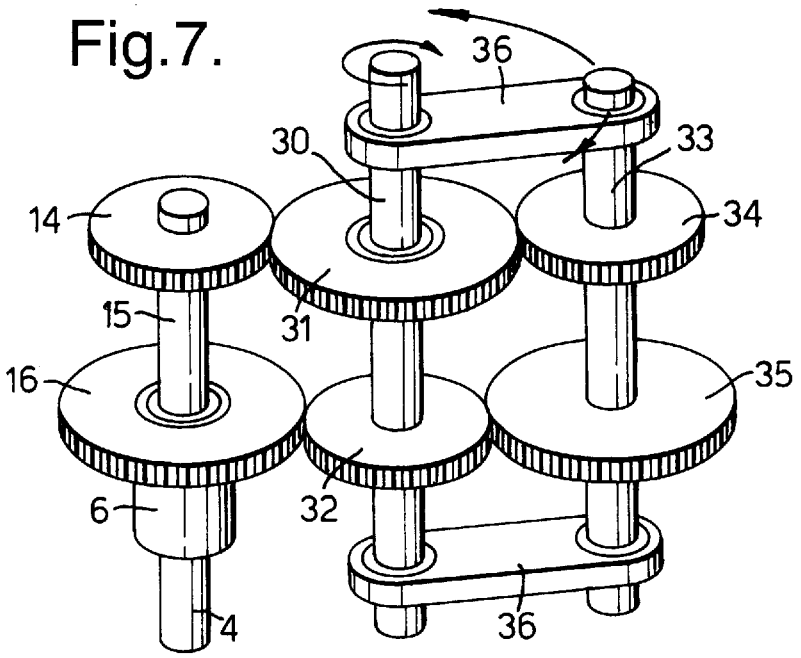
FIG. 7 is an isometric view of a drive mechanism for the apparatus.
Figure 8:
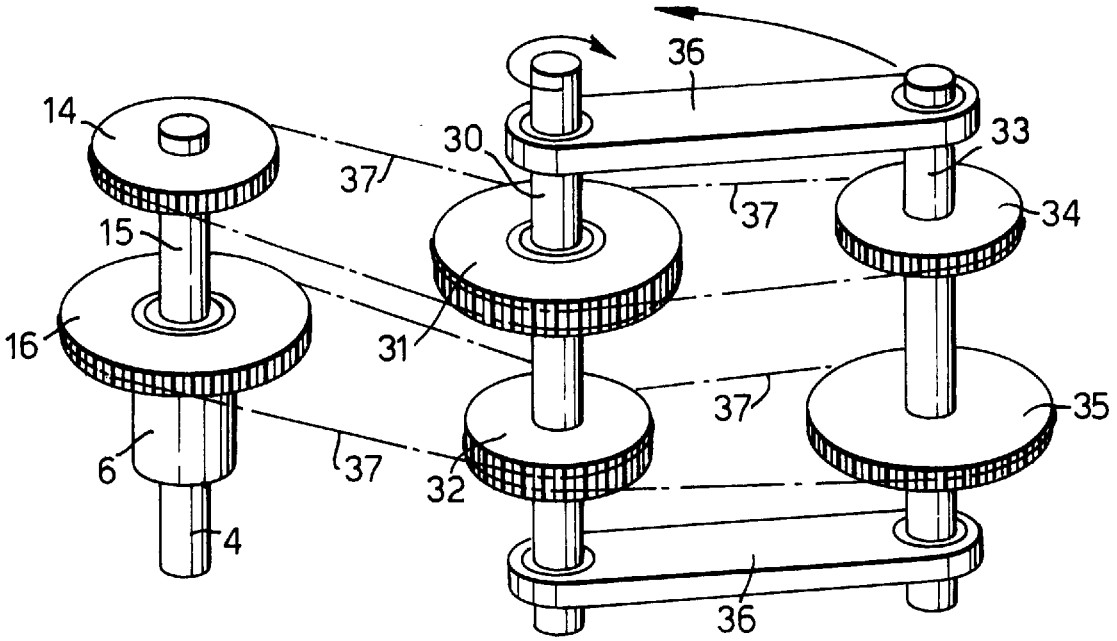
FIG. 8 is an isometric view similar to that of FIG. 7 for an alternative drive mechanism.

FIG. 7 is a diagrammatic view of a drive mechanism for the apparatus and shows drive gear 14 fixedly mounted on the cylindrical extension 15 of sleeve 4 and the drive gear 16 freely mounted on extension 15 and coupled to sleeve 6. Extension 15 acts as an output shaft for this mechanism. An input shaft 30 carries an upper gear 31 freely mounted thereon and a lower fixed gear 32. Gears 31 and 32 mesh with gears 14 and 16. A lay shaft 33 carries an upper fixed gear 34 and a lower fixed gear 35. The lay shaft is freely mounted on, and is coupled to the input shaft by arms 36 which can rotate about the input shaft to a limited degree. Gears 34 and 35 mesh with gears 31 and 32. Gears 14, 32 and 34 are the same size as one another. Gears 16, 31 and 35 are larger but again the same size as one another. The train of drive to gear 14 and thus to extension 15 acting as the output shaft is: input shaft 30, gear 32, gear 35, lay shaft 33, gear 34, gear 31, gear 14. The train of drive to the gear 16 is: input shaft 30, gear 32, gear 16. Thus gear 16 is driven directly with the input shaft and is not affected by the lay shaft. When the lay shaft is moved around the input shaft the relative rotary positions of the gears 31 and 32 is altered. This in turn alters the relative rotary positions of the gears 14 and 16 and thus the relative rotary positions of the sleeves 4 and 6. Thus movement of the lay shaft 33 by rotation of the arms 36, about the input shaft 30 can control the phase angle between the sleeves 4 and 6 and thus the eccentricity of the movement of the tool holder 8.

Figure 9:
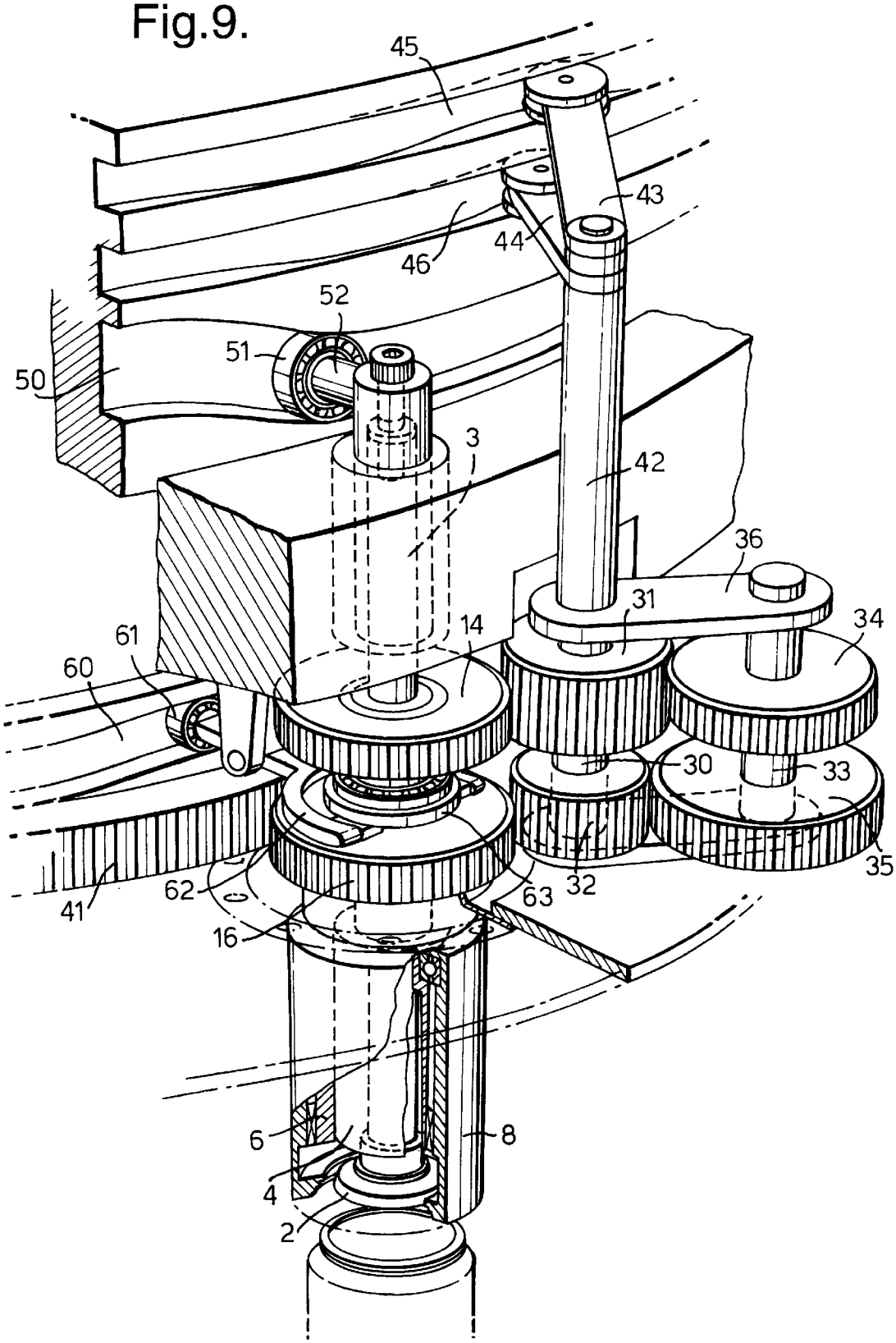
FIG. 9 is a partial perspective view of a machine incorporating apparatus in accordance with the invention.
Figure 10:
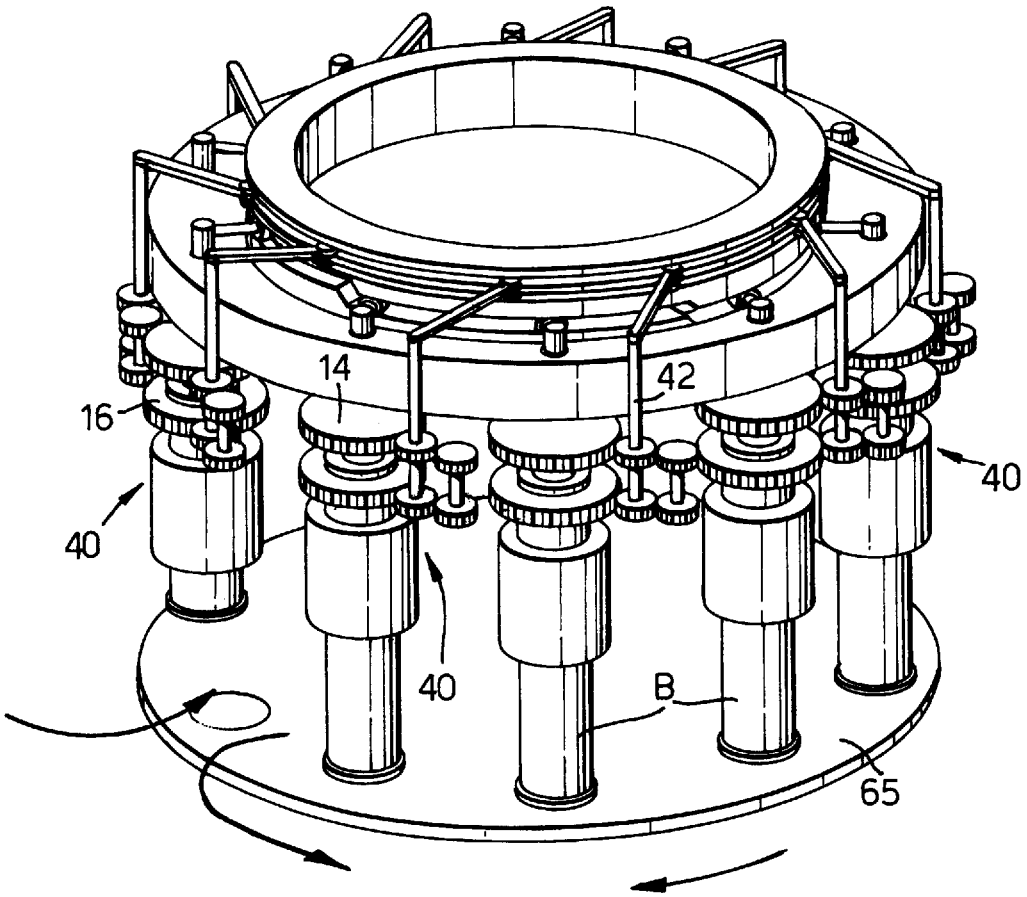
FIG. 10 is a simplified perspective view of the machine of FIG. 9.

A machine shown in FIG. 9 and FIG. 10 shows a plurality of seaming stations 40 progressing around the frame of the machine in carousel fashion. A single seaming station is shown in more detail in FIG. 9. In this embodiment, the gear 16 meshes with a gear 41 which is fixed on the machine. Rotation of gear 16 is imparted as the station 40 progresses around the machine. Drive to gear 16 in this case is thus very direct. Gear 16 also meshes with fixed gear 32 on shaft 30 which is thus the input shaft for this drive mechanism and which is freely mounted. Gear 32 meshes with fixed gear 35 on lay shaft 33 and fixed gear 34 on the lay shaft meshes with gear 31 freely mounted on shaft 30. Gear 31 meshes with gear 14 for driving the inner eccentric 4. Drive train to gear 14 is: gear 41, gear 16, gear 32, gear 35, lay shaft 33, gear 34, gear 31, gear 14. The lay shaft 33 is rotated about shaft 30 by rotation of a shaft 42 extending upwardly from upper arm 36. Rotation of shaft 42 is controlled by a pair of cam followers 43,44 which follow cam tracks 45,46 extending around the frame of the machine. In the same way as described previously, movement of the lay shaft 33 around the input shaft 30 controls the phase angle between sleeves 4 and 6. Thus, cam track 45 determines the phase angle during seaming by the lower profile 12 while cam track 46 determines the phase angle during seaming by the upper profile 13.

Cam followers 43 and 44 may be adjusted individually in angular position relative to shaft 42 during machine set up. By this means, and by designing cam 45 so that it is disengaged from cam follower 43 during seaming by the upper profile and similarly for cam 46 and cam follower 44 during seaming by the lower profile, adjustment of each profile seaming operation is possible.

A further cam track 50 formed in the machine frame is engaged by a follower 51 rotatably mounted on the end of a link 52 which is coupled to the upper end of the seaming chuck shaft 3. Cam track 50 controls the vertical position of the seaming chuck and in particular it controls the lowering of the seaming chuck into engagement with a can end seated on a can body, and the raising of the chuck out of engagement therewith after seaming to permit a subsequent can body and can end to be introduced. Components which are raised and lowered with the seaming chuck 2 include: shaft 3, gear 14, extension 15 and inner eccentric sleeve 4.

A yet further cam track 60 formed in the machine frame is engaged by a follower 61 on one end of a pivotally mounted yoke 62. The yoke is coupled to a bearing 63 mounted on the top of gear 16. Thus vertical movement of the follower 61 causes vertical movement of gear 16, coupling 18, sleeve 6, and seaming tool 8. Thus cam track 60 controls the vertical position of the seaming tool 8 and the seaming profiles 12,13 thereon.

The overall machine view of FIG. 10 shows that filled can bodies with can ends loosely in place are fed to an entry point on a rotating floor 65 and are carried around the machine by a seaming station to an exit point adjacent the entry point.

Figure 11:
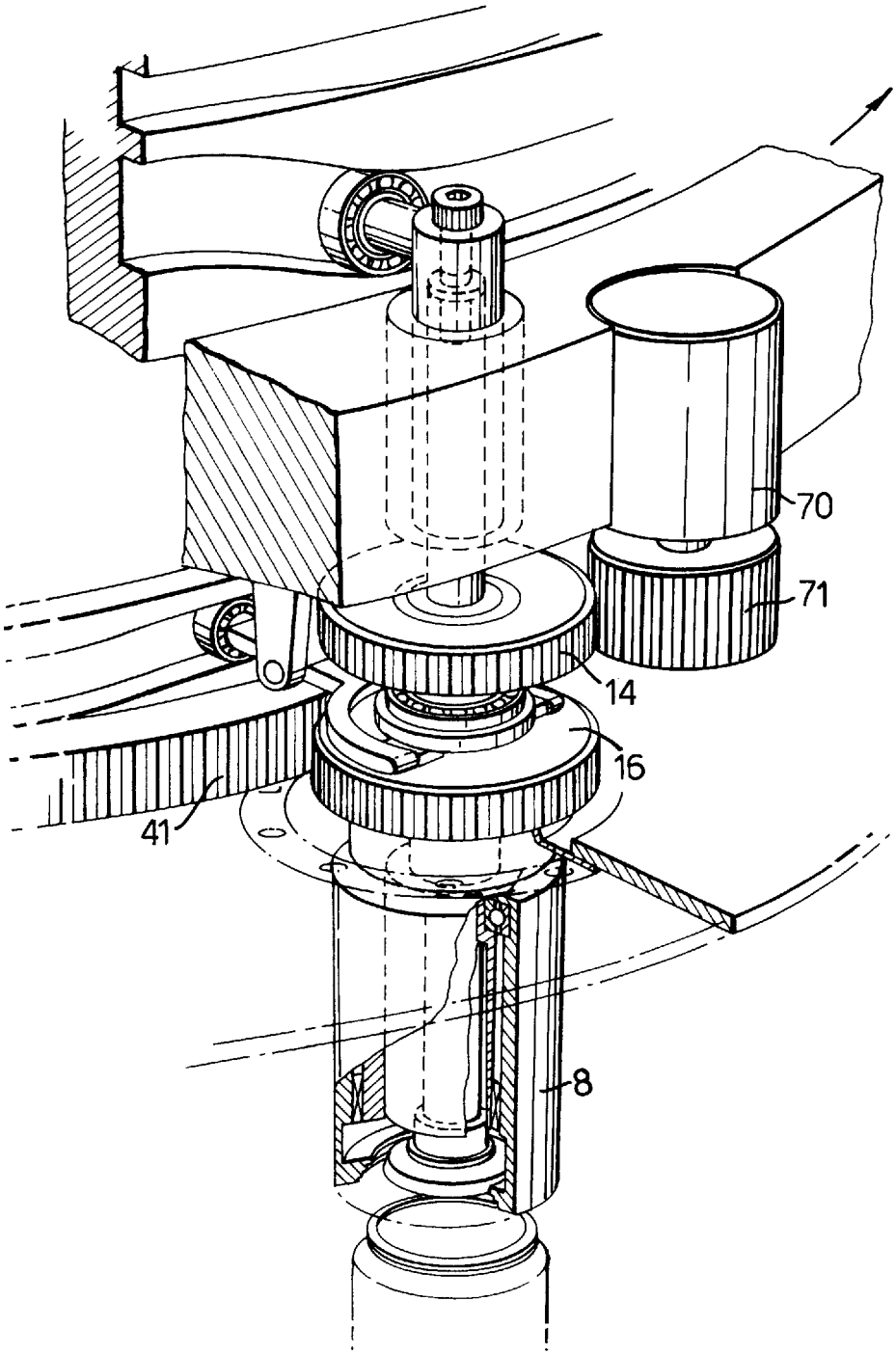
FIG. 11 is a perspective partial view of a further machine incorporating apparatus in accordance with the invention.
Figure 12:
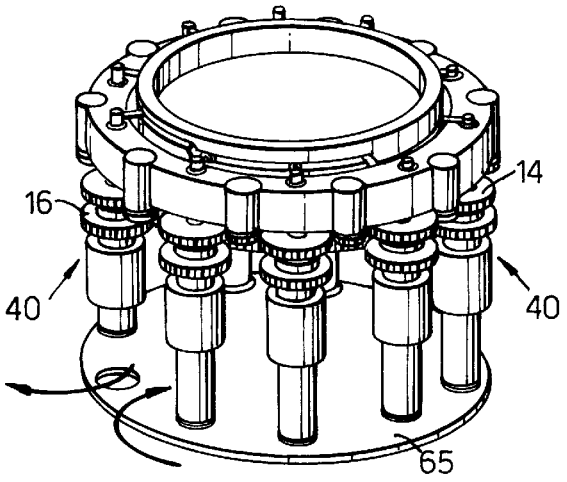
FIG. 12 is a simplified perspective view of the machine of FIG. 11.

In a further embodiment shown in FIGS. 11 and 12 the drive mechanism for the gear 14 is provided by a servo-motor 70 having a gear 71 on its output shaft. The servo-motor is controlled to rotate the gear 14 and thus the inner sleeve 4. The gear 16 and thus the outer eccentric 6 is driven in rotation as before at a constant speed by virtue of its engagement with the gear 41 which provides a constant drive means. The phase angle between the inner and outer sleeves can be precisely controlled by controlling the speed of the servo-motor.

Figure 13:
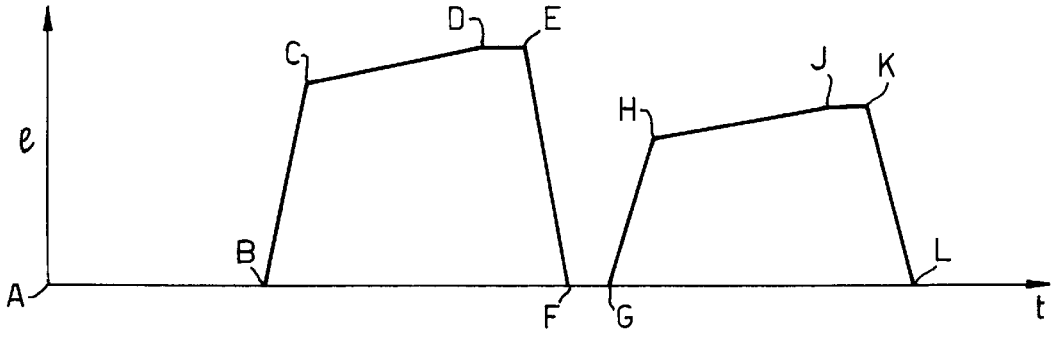
FIG. 13 is a graph showing the degree of eccentricity applied to the seaming tool against time during the seaming operation.

The operation of a seaming station will be described with particular reference to FIG. 13. As a filled can body is delivered to a seaming station the chuck 2 is in its raised position. As the chuck is lowered towards the can body it collects a can end which is moved to rest centrally on the flange of the filled can body. This is the position represented by point B on FIG. 13. Between points A and B, the inner and outer sleeves are driven to rotate at the same speed with a zero phase angle between them. Thus, over this period the eccentricity of the seaming tool is nil and the lower seaming profile 12 is coaxial with the can end and surrounds the seaming flange of the can end with a slight radial spacing all around. Between points B and C the phase angle between the sleeves 4 and 6 is rapidly increased, thus increasing the eccentricity of seaming tool 8. At point C, the eccentricity of tool 80 is such that the seaming profile 12 just engages the can end and begins to gyrate around it; both the can end and the can body being held against rotation by the seaming chuck 2. Between points C and D, the eccentricity of the seaming tool 80 is increased more slowly to a maximum at point D. During this time the seaming tool progressively folds the peripheral portions of the can end and the can body together to begin to form a seam (known as a double seam). The eccentricity is maintained at a maximum between points D and E representing at least one orbit of the tool around the can end. Between points E and F the phase angle between the sleeves is rapidly reduced to zero such that the seaming tool disengages the can end. Between points F and G, the tool holder 80 is lowered such that the upper seaming profile 13 is aligned with the can end and the now partly-formed seam. Between points G and L the process described in relation to points B to F is repeated as the upper seaming profile completes the seam. Just after point L, the chuck is raised off the can end. The can body with its end now fitted by a double seam is then removed for the whole operation to be repeated on a succeeding can body and can end.

Between points A and L, the can is very slightly raised by the support pad 1 to account for the loss of height of the can body as its seaming flange is gradually folded over into the newly formed double seam. To achieve this, the support pad may be resiliently mounted to provide a constant upward force on the base of the can body.

Apart from the drive mechanisms already described, several other alternatives are possible. In one possibility, both eccentric sleeves can be driven by servo-motors.

Whilst it is preferred to bring the chuck into engagement of the can end by vertical movement of the chuck, it would be possible to effect this by vertical movement of a lifter pad such as shown in FIG. 1.

Two seaming profiles are provided on the apparatus as described but a greater number could be provided if required.

Further modified embodiments are described below with reference to FIGS. 14 and 15.

Figure 14:
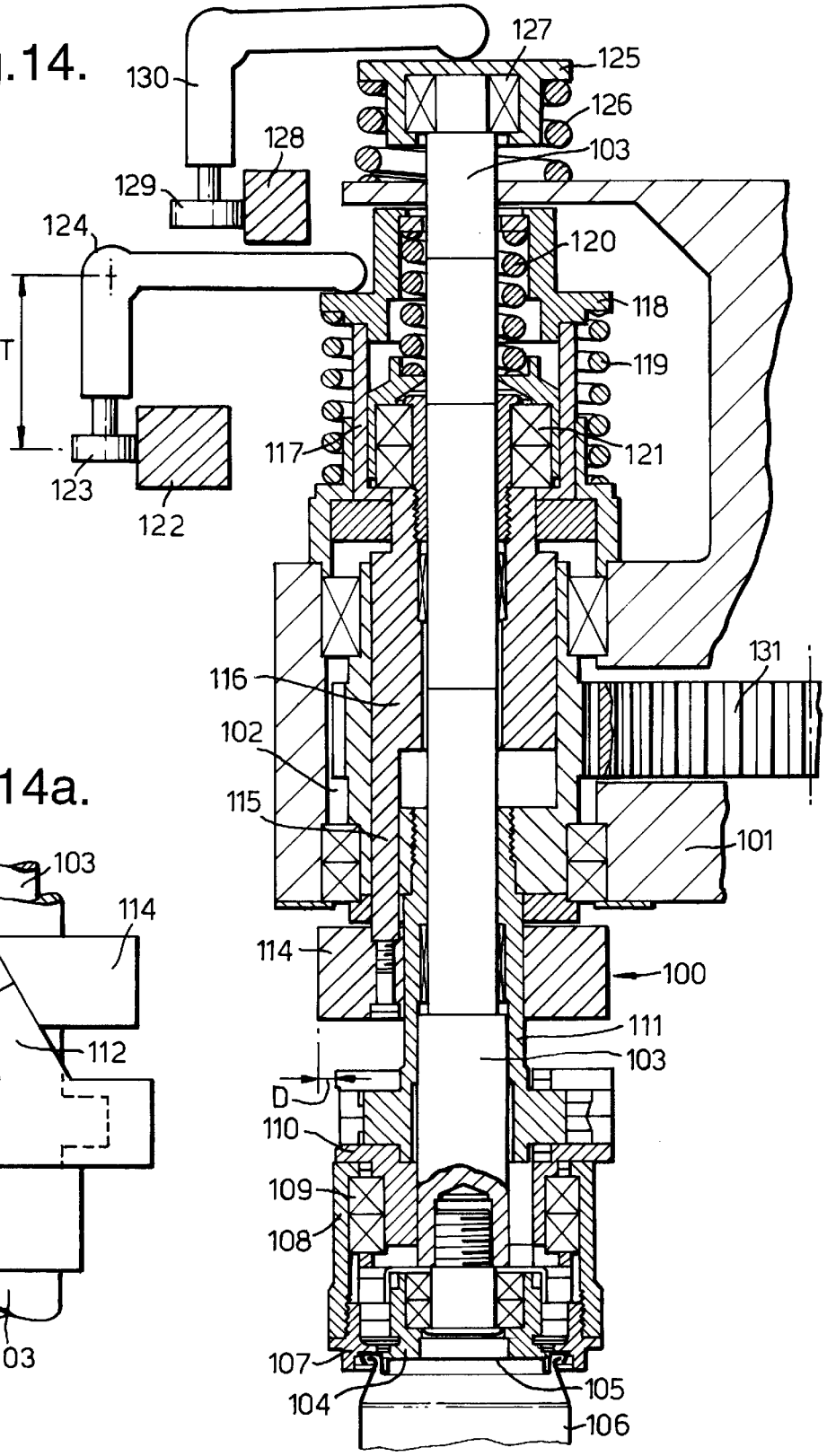
FIG. 14 is a sectioned fragmentary view of another embodiment of the apparatus.
Figure 14A:
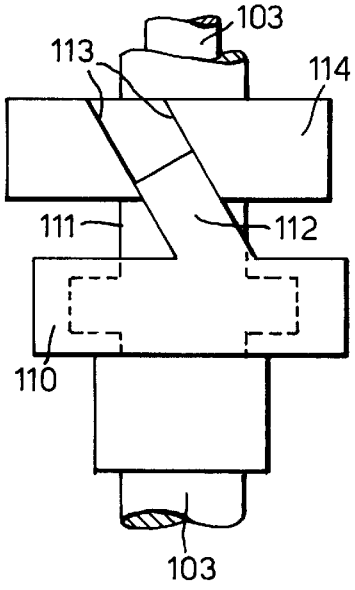
FIG. 14*a* is a fragmentary view of a cross slide as used in the apparatus FIG. 14.

In FIG. 14 the apparatus comprises a plurality of seam forming assemblies 100 mounted equispaced around turret 101 for rotation under cam rings 122 and 128. Each seam forming assembly 100 comprises a central shaft 103 which supports a chuck 104 in axial alignment with a can lifter pad (not shown). The chuck 104 serves to hold a can end 105 on the flange of a can body 106 as an annular tool 107 is moved laterally from a position concentric with the chuck to progressively form a can double seam of end to body as the annular tool gyrates around the can end 105 on chuck 104.

In FIG. 14 the vertical axis of the annular tool 107 is shown aligned with the vertical axis of the central shaft 103. The annular tool 107 is supported for rotation on an annular tool holder 108 supported for free rotation on ceramic bearing 109 on a cross slide 110. The cross slide 110 is carried on parallel sided surfaces of a sleeve 111 having a central bore, surrounding the central shaft so that both sleeve 111, cross slide 110 and tool holder 108 may rotate around the central shaft but only the cross slide and the tool holder 108 carried thereon can move laterally the distance "D".

The cross slide 110 has two driven pegs or followers 112, opposite sides of which engage inclined cam surfaces 113 on a transfer disc 114. As the disc 114 moves vertically towards or away from the cross side, the cam surfaces urge the cross slide to move laterally. A benefit of this use of sloping dog or peg surfaces and transfer disc surfaces is that linear motion of the transfer disc along the central shaft gives continuous control of the lateral of the cross side motion and thus the movement of the seaming tool 107 carried on tool holder 108 towards and away from the can end being seamed. There is design choice as to where to locate the cross slide. For instance the peg may be on the transfer disc and located nearer the tool holder 108. If desired, the transfer disc may be controlled to cause a gradual approach of the annular tool 107 to the can end over several orbits of the tool holder around a stationary can.

The transfer disc 114 is urged to move along the central shaft 103 by push rods 115 bolted to the transfer disc and rotated in a sleeve 116. The sleeve 116 is held up (as shown in FIG. 14) by carrier tubes 117 having a flanged end members 118 held in this displaced condition by a spring 119. The linkage of flanged member 118, carrier tube 117, sleeve 116, push rods 115 and transfer disc 114 are all moved by cam 122 via lever 124 as this assembly is carried along the cam profile to progressively turn the can end flange into a double seam as the turret rotates.

The sleeve 111 and cross side are driven to rotate by the gear 131 which may be separately driven as the turret rotates. The annular tool 107 may make several revolutions before completing a seam operation.

As shown, the cam 122 acts on the follower 123 which is attached to the lever 124. The follower 123 is arranged to be adjustable along its axis of rotation on the lever 124. In this way the mechanical advantage of lever 124 can be altered by adjusting distance "T". Consequently the position of the seaming annular tool 107 can be reset even with a fixed cam. The cam profile may include first and second or more operations. Adjustment of the first operation throw and the second operation throw independently of each other can be accomplished by using two lever/follower assemblies acting on two separate cam tracks.

The push pull functions of springs 119 and 120 may be replaced by a simple follower if a desmodronic (grooved) cam is used instead of the single surface cam 122, follower 123 and lever 124 of FIG. 14.

The chuck 104 and lifter (not shown) are constrained to work together by separate cams to hold the can 106 at different heights to enable more than one operation to be carried out on the same seaming forming assembly 100. The chuck 104 may be raised or lowered by the action of the cam 128 acting on the follower 129 which is attached to the lever 130. The lever operates on the housing 125 and is opposed by the spring 126. The non rotating housing 125 operates on the rotating shaft 103, via the bearing 127, raising or lowering the chuck.

Figure 15:
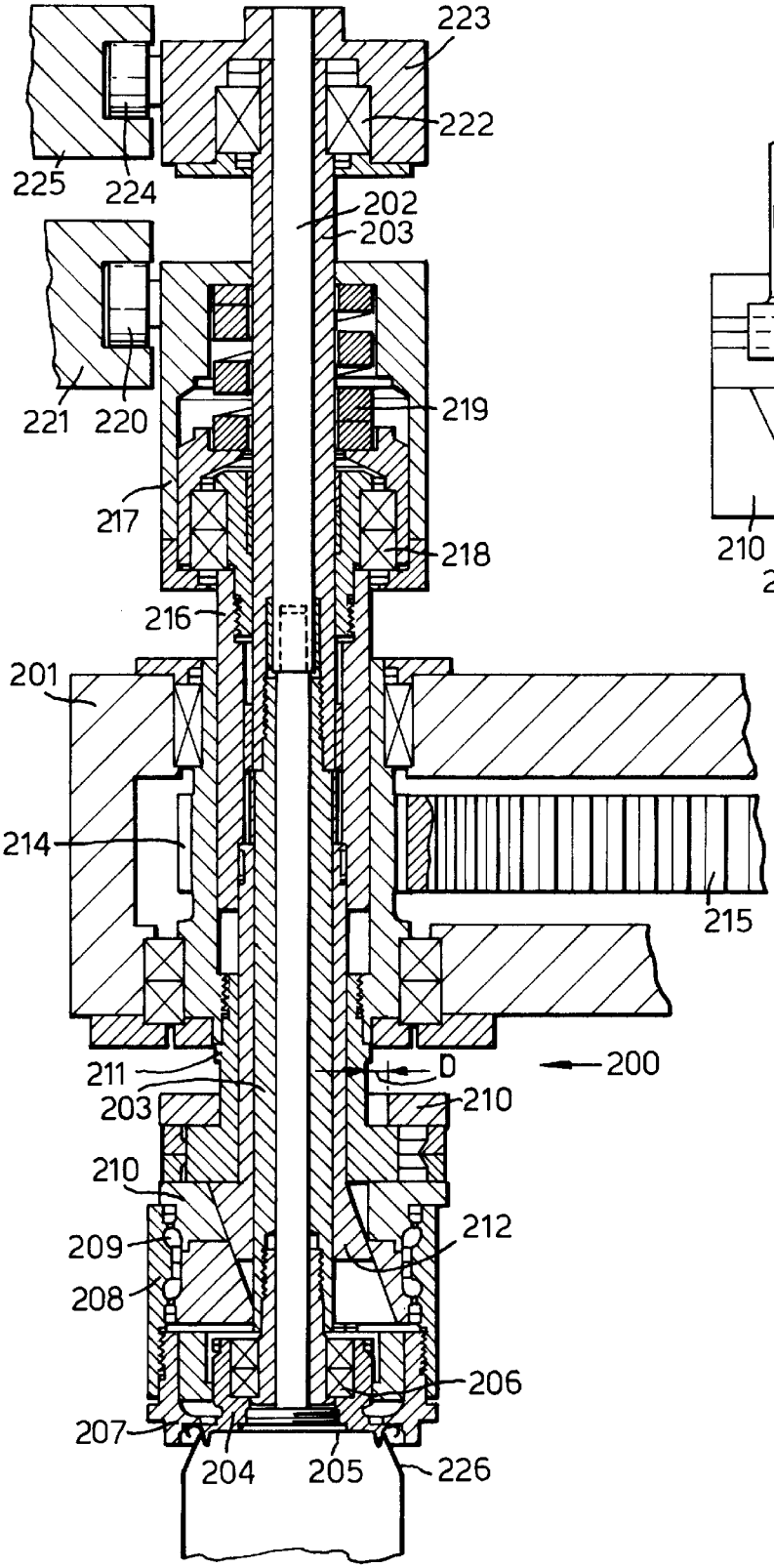
FIG. 15 is a sectioned fragmentary view of another embodiment of the apparatus.

In FIG. 15, the apparatus may comprise a single seam forming assembly 200 capable of forming a seam on a known can, or other container suitable for containing food, drink or other material, and a suitable end or lid. The seaming assembly 200 may be operated on by cams 221 and 225 as shown, or by known servo drives in place of the cams.

Alternatively a plurality of seam forming assemblies 200 may be grouped together and operated on by known servo drives in place of the shown cams 221 and 225.

Alternatively, as indicated in FIG. 15, a plurality of seam forming assemblies 200 may be mounted equispaced around a turret 201 for rotation round cam rings 221 and 225.

In FIG. 15 the seam forming assembly 200 comprises a non-rotating shaft 202 clamped in housing 223 which prevents rotation of the chuck 204 on bearings 206 (which have ceramic, or other material, balls). The bearings 206 are mounted on a main shaft 203 which does rotate. The chuck 204 is in axial alignment with a non rotating lifter pad (not shown), thereby holding the can 226 and can end 205 together at the determined height for seaming. A seam is progressively formed, in one or more operations, on the can and end by an annular tool 207 which has one or more seaming profiles arranged axially separate from each other on its internal diameter. The seaming takes place when the seam tool 207 is moved laterally from a position concentric with the chuck 204 to progressively form a seam of can end to can body as the annular tool 207 gyrates around the can end 205 on the chuck 204.

In FIG. 15 the vertical axis of the annular tool 207 is shown aligned with the vertical axis of the shafts 202 and 203. The annular tool 207 is supported for rotation on an annular tool holder 208 supported for rotation by ball bearings 209 (of ceramic or other material) on a cross slide 210. The cross slide 210 is carried on parallel sided surfaces which are part of sleeve 211. The combination of cross slide 210 and sleeve 211 is a linear slide which carries the annular tool 207 via the tool holder 208 and bearings 209 enabling the vertical axis of the annular tool holder 208 and the annular tool 207 to be positioned concentric with or eccentric to the chuck 204 vertical axis. The sleeve 211 and cross slide 210 rotate with the main shaft 203, whilst the cross slide 210 and tool holder 208 can move laterally by the distance "D" indicated.

Figure 15A:
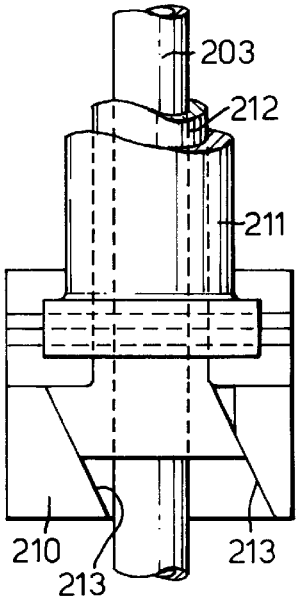
FIG. 15*a* is a fragmentary view of a cross slide as used in the apparatus of FIG. 15.

As shown in FIG. 15 and FIG. 15*a*, the cross slide 210 includes a parallel, inclined axis bore 213 in which a portion of an inclined axis cylinder being part of the transfer tube 212, snugly locates. The transfer tube 212 includes a bore with vertical axis in line with shaft 203 to accommodate shaft 203. As the transfer tube 212 is moved downwardly on the axis of the main shaft 203, from the position indicated in FIG. 15*a*, the inclined cylindrical surface of the transfer tube causes the cross slide 210 to move leftwards by sliding down the inclined bore 213. In this manner linear motion of the transfer tube along the main shaft axis gives continuous control of the lateral movement of the cross slide and thus of movement of the tool 207 towards or away from the can and end being seamed. Since the sleeve 211, cross slide 210 and transfer tube 212 rotate with the main shaft, the eccentricity of the cross side and thus of the annular tool 207 may be controlled to cause a gradual approach of the annular tool to the can end over several orbits of the tool round the stationary can.

The transfer tube 212 is urged to move along the main shaft 203 by thrust sleeve 216 which is internally splined to engage with external splines on the main shaft 203. The thrust sleeve 216 is attached to the lower follower housing 217 using bearings 218. The lower housing 217 does not rotate on the axis of seaming forming assembly 200. As shown, cam 221 acts on the follower 220 attached to the housing 217. Consequently the lateral position of the seaming tool 207 can be controlled by the profile of the cam 221, as the seaming forming assembly 200 is rotated around the turret axis, allowing the follower 220 to ride on the stationery cam 221. The cam profile may include first and second or more operations.

Alternatively, the lower housing 217 may be operated on by one or more levers and face cams, as described previously and shown in FIG. 14.

Alternatively, the lower housing 217 may be operated on by a known servo controlled electric, hydraulic or pneumatic mechanism to cause the required lateral movement for one or more seaming operations on each seaming forming assembly 200.

The lower follower housing 217 incorporates a safety spring 219 sized to compress only when an overload condition occurs between the annular tool 207 and the chuck 204. The seaming assembly gear 214 is driven to rotate by the turret gear 215 which may be separately driven as the turret rotates. The gear 214 rotates the sleeve 211 which in turn rotates the cross slide 210, the transfer tube 212, the thrust sleeve 216 and the main shaft 203 via the splines.

The chuck 204 and non rotating lifter (not shown) are constrained to work together by separate cams to hold the can 226 and end 205 together at different heights aligned with the different internal annular seaming profiles on the seam tool 207. This enables one or more seaming operations to be carried out on the same seam forming assembly 200. The chuck 204 may be raised or lowered by the action of cam 225 acting on the follower 224 which is attached to the upper follower housing 223. The upper housing does not rotate on the seaming forming assembly vertical axis but acts on the rotating main shaft 203, via the bearings 222. Movement of the main shaft 203 imposed by cam 225 results in controlled vertical positioning of the chuck 204.

Alternatively, the upper housing 225 may be operated on by a lever and face cam as described previously and shown in FIG. 14.

Alternatively, the upper housing 225 may be operated on by a known servo controlled electric, hydraulic or pneumatic mechanism to cause the required vertical movement for one or more seaming operations on each seam forming assembly 200.

We claim:

1. Apparatus for seaming a container end to an open end of a container body in at least first and second seaming operations comprising:

means for supporting a container body;

a seaming chuck for supporting a container end in place on the container body;

means for progressively folding peripheral portions of the container body and the container end together to form a seam; said means for progressively folding being an annular seaming tool having at least first and second axially spaced annular seaming profiles on an inner surface of said annular seaming tool which surrounds the container end, drive means for providing relative rolling movement between the annular seaming tool and the container end to progressively form a seam, the drive means drives the annular seaming tool to gyrate around the container end, and means for causing relative axial movement between the container end and the annular seaming tool from a first relative axial position in which the first annular seaming profile can contact the container end to perform the first seaming operation to at least a second relative axial position in which the second annular seaming profile can contact the container end to perform the second seaming operation.

2. Apparatus according to claim 1, wherein the annular seaming tool is mounted on a tool holder for rotation therewith, the tool holder includes an axis, and the tool holder is mounted on the apparatus for free rotation about said tool holder axis.

3. Apparatus according to claim 2, wherein the tool holder is mounted for free rotation on a cross slide, said cross slide is mounted for rotation with a sleeve rotatably driven on an axis of the seaming chuck, the cross slide can be moved transverse to a longitudinal axis of the sleeve to vary the location of a centre axis of the tool holder and the annular seaming tool between a centred position in which the axis of the annular seaming tool is aligned with the axis of the seaming chuck and off centre positions in which the axis of the annular seaming tool orbits the axis of the seaming chuck.

4. Apparatus according to claim 3, wherein the cross slide is moved transverse to a longitudinal axis of the sleeve by opposed cam surfaces.

5. Apparatus according to claim 1, wherein the seaming tool is mounted for free rotation on the tool holder.

6. Apparatus according to claim 1, wherein the drive means comprises an inner eccentric sleeve mounted for rotation about an axis of the seaming chuck, an outer eccentric sleeve mounted for rotation about the inner eccentric sleeve, a drive mechanism for driving the inner and outer eccentric sleeves; and the annular seaming tool is mounted for rotation on the outer eccentric sleeve.

7. Apparatus according to claim 6, wherein the drive mechanism is arranged to drive the inner and outer eccentric sleeves in an identical direction of rotation, and includes adjustment means for controllably varying a phase angle between the inner and outer eccentric sleeves to thereby vary annular seaming tool eccentricity.

8. Apparatus according to claim 7, wherein the annular seaming tool eccentricity is nil when the phase angle between the inner and outer eccentric sleeves is zero and is at a maximum when the phase angle is 180°.

9. Apparatus according to claim 7, wherein the drive mechanism includes an input shaft, an output shaft and a lay shaft coupled to be driven together; the lay shaft is movable about the input shaft to vary the phase angle between the input shaft and the output shaft; and one of the inner and outer eccentric sleeves is driven by the input shaft and the other of the inner and outer eccentric sleeves is driven by the output shaft.

10. Apparatus according to claim 9, wherein the input shaft, output shaft and lay shaft are coupled together through intermeshing gears mounted on the shafts.

11. Apparatus according to claim 9, wherein the input shaft, output shaft and lay shaft are coupled together by timing belts engaging timing pulleys mounted on the shafts.

12. Apparatus according to claim 7, wherein the drive mechanism includes a constant drive means and a servo-motor; and one of the inner and outer eccentric sleeves is driven by the constant drive means and the other of the inner and outer eccentric sleeve is independently driven by the servo-motor.

13. Apparatus according to claim 7, wherein the drive mechanism includes inner and outer servo-motors for independently driving the two eccentric sleeves.

14. Apparatus according to claim 1, wherein the container body support means comprises a lifter pad movable between upper and lower positions.

15. Apparatus according to claim 1, wherein the seaming chuck is movable between upper and lower positions.

16. Apparatus as claimed in claim 1, wherein the annular seaming tool has an axis of rotation, the seaming chuck has an axis of rotation, and means for selectively varying the distance between said last-mentioned two axes of rotation.

17. Apparatus according to claim 16, wherein the tool holder is mounted for free rotation on a cross slide, said cross slide is mounted for rotation with a sleeve rotatably driven on an axis of the seaming chuck, and the cross slide is mounted for transverse movement to a longitudinal axis of the sleeve to vary the location of a centre axis of the tool holder and the annular seaming tool between a centred position in which the axis of the annular seaming tool is aligned with the axis of the seaming chuck and off centre positions in which the axis of the annular seaming tool orbits the axis of the seaming chuck.

* * * * *